US011469032B2

(12) United States Patent
Inaba

(10) Patent No.: US 11,469,032 B2
(45) Date of Patent: Oct. 11, 2022

(54) WIRE HARNESS AND METHOD FOR MANUFACTURING THE SAME

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Kazuhiro Inaba, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 381 days.

(21) Appl. No.: 16/763,081

(22) PCT Filed: Nov. 6, 2018

(86) PCT No.: PCT/JP2018/041171
§ 371 (c)(1),
(2) Date: May 11, 2020

(87) PCT Pub. No.: WO2019/102841
PCT Pub. Date: May 31, 2019

(65) Prior Publication Data

US 2020/0294701 A1 Sep. 17, 2020

(30) Foreign Application Priority Data

Nov. 21, 2017 (JP) ..... JP2017-223946

(51) Int. Cl.
*H01F 27/24* (2006.01)
*H01F 27/29* (2006.01)
(Continued)

(52) U.S. Cl.
CPC ..... *H01F 27/24* (2013.01); *H01F 27/02* (2013.01); *H01F 27/29* (2013.01); *H01F 41/04* (2013.01)

(58) Field of Classification Search
None
See application file for complete search history.

(56) References Cited

U.S. PATENT DOCUMENTS

2012/0092120 A1* 4/2012 Yoshikawa ..... H01F 27/327 336/221
2014/0293655 A1* 10/2014 Inaba ..... H01F 3/08 336/90
(Continued)

FOREIGN PATENT DOCUMENTS

JP 2008-041876 A 2/2008
JP 2011-253982 A 12/2011
(Continued)

OTHER PUBLICATIONS

Dec. 11, 2018 Search Report issued in International Application No. PCT/JP2018/041171.

*Primary Examiner* — Jared Fureman
*Assistant Examiner* — Aqeel H Bukhari
(74) *Attorney, Agent, or Firm* — Oliff PLC

(57) ABSTRACT

A reactor including: a coil having a wound portion; a magnetic core that is disposed inside and outside the wound portion and forms a closed magnetic circuit; and a resin mold that includes an inner resin disposed between the wound portion and the magnetic core, and does not cover an outer-peripheral face of the wound portion.

7 Claims, 3 Drawing Sheets

(51) Int. Cl.
*H01F 27/02* (2006.01)
*H01F 41/04* (2006.01)

(56) References Cited

U.S. PATENT DOCUMENTS

| | | | | |
|---|---|---|---|---|
| 2014/0320256 | A1* | 10/2014 | Inaba | H01F 27/00 336/221 |
| 2017/0110243 | A1 | 4/2017 | Kawashima et al. | |
| 2019/0259532 | A1 | 8/2019 | Hirabayashi et al. | |

FOREIGN PATENT DOCUMENTS

| | | | |
|---|---|---|---|
| JP | 2014-120743 | A | 6/2014 |
| JP | 2015-211143 | A | 11/2015 |
| JP | 2017-117817 | A | 6/2017 |

* cited by examiner

WIRE HARNESS AND METHOD FOR MANUFACTURING THE SAME

The present application claims priority of Japanese Application No. 2017-223946 filed Nov. 21, 2017, the entire contents of which is incorporated herein by reference.

BACKGROUND

JP 2017-135334A discloses, as a reactor for use in a vehicle converter or the like, a reactor that includes a coil, a magnetic core, and a resin mold portion. The coil includes a pair of wound portions. The magnetic core includes a plurality of inner core pieces that are disposed in the respective wound portions, and two outer core pieces that are disposed outside the wound portions, and these core pieces are fitted to form a ring shape. The resin mold portion covers the outer periphery of the magnetic core, and exposes the coil rather than covering it.

SUMMARY

A reactor according to the present disclosure includes: a coil having a wound portion; a magnetic core that is disposed inside and outside the wound portion and forms a closed magnetic circuit; and a resin mold n that includes an inner resin disposed between the wound portion and the magnetic core, and does not cover an outer-peripheral face of the wound portion, the magnetic core including: an inner core piece including: a base having a predetermined magnetic-path cross-sectional area and arranged in the wound portion; and a connection end having a magnetic-path cross-sectional area smaller than the magnetic-path cross-sectional area of the base and provided at an end of the base; and an outer core piece including a large-area portion having a magnetic-path cross-sectional area larger than the magnetic-path cross-sectional area of the base, the outer core piece being exposed from the wound portion, wherein the outer core piece has a relative permeability higher than a relative permeability of the inner core piece, and the resin mold includes a thick portion covering a connecting area between the connection end and the outer core piece, the thick portion being thicker than an area of the resin mold portion that covers the base.

DETAILED DESCRIPTION OF EMBODIMENTS

Figure 1:
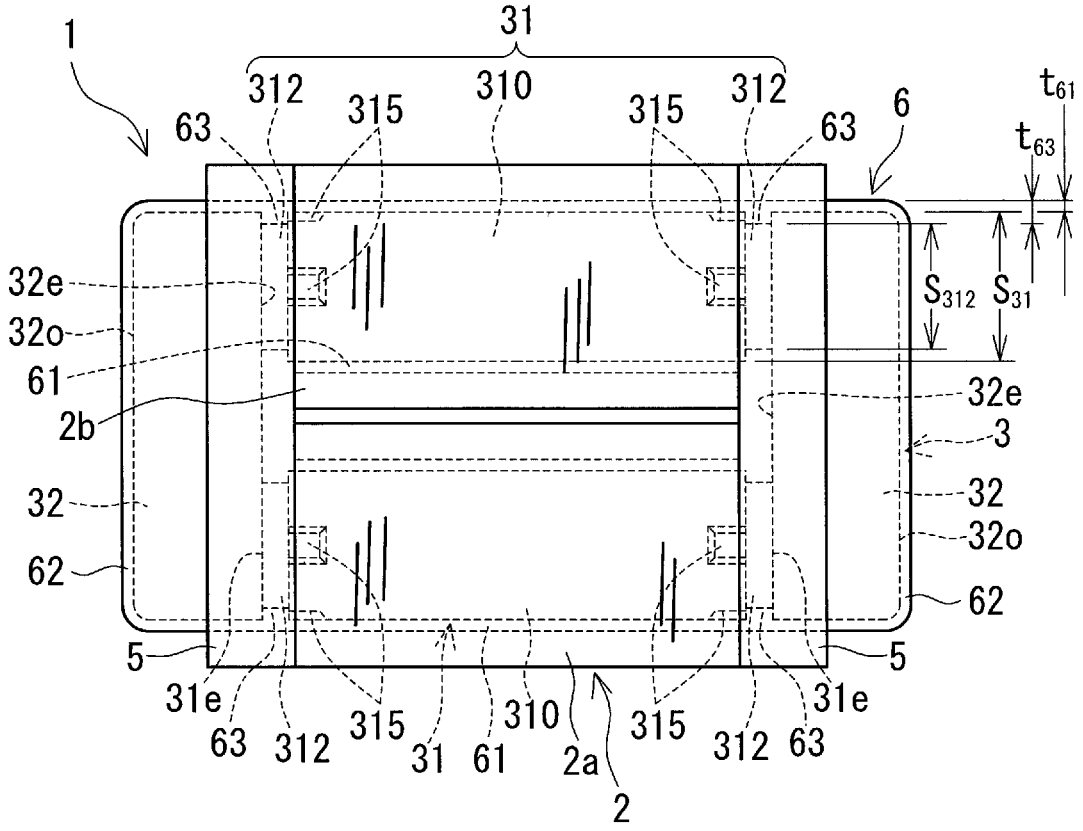
FIG. 1 is a schematic plan view of a reactor according to Embodiment 1.

There is a demand for a high-strength reactor of which a resin mold portion can be readily formed.

As described in JP 2017-135334A, in a case where a magnetic core that includes inner core pieces and outer core pieces is integrally held by a resin mold portion, it is particularly desirable to increase the connection strength between the inner core pieces and the outer core pieces such that the magnetic core has excellent strength as an integrated body. For example, if the overall thickness of the resin mold portion is increased, the aforementioned connection strength can be increased, but consequently, the size of the reactor will increase.

Also, each of the outer core pieces described in JP 2017-135334A is a columnar body whose inner end face, to which end faces of the inner core pieces are connected, is a uniform flat face, and lower faces of the outer core pieces protrude downward of lower faces of the inner core pieces. Due to the outer core piece having such protruding portions, it is difficult to form a resin mold portion that covers the outer periphery of the magnetic core while exposing the coil. This is because it is difficult to introduce a fluid-state resin (which will be hereinafter referred to also as a molding material), which is a material of the resin mold portion, into a cylindrical gap between the wound portions and the inner core pieces.

Specifically, if the inner core pieces are fitted to the outer core pieces that have the aforementioned protruding portions, the outer core pieces are arranged so as to block, at least partially, opening portions formed by inner-peripheral edges of the wound portions and peripheral edges of the end faces of the inner core pieces. If the opening portions are closed by the outer core pieces, the opening area of the opening for introducing the molding material to into the cylindrical gap becomes small. For this reason, it is difficult to introduce the molding material into the cylindrical gaps. In particular, the molding material is yet more difficult to charge in a case where, for example, the cylindrical gap is further narrowed to make a smaller reactor. Accordingly, a configuration is desired that facilitates charging of the molding material even if the cylindrical gap is narrower.

An exemplary aspect of the disclosure provides a high-strength reactor of which a resin mold portion can be readily formed.

The above-described reactor has excellent strength, and the resin mold portion thereof can be readily formed.

DESCRIPTION OF EMBODIMENTS OF PRESENT DISCLOSURE

First, embodiments of the present disclosure will be listed and described.

(1) A reactor according to an embodiment of the present disclosure includes:

a coil having a wound portion;

a magnetic core that is disposed inside and outside the wound portion and forms a closed magnetic circuit; and a resin mold portion that includes an inner resin portion disposed between the wound portion and the magnetic core, and does not cover an outer-peripheral face of the wound portion, the magnetic core including:

an inner core piece including: a base portion having a predetermined magnetic-path cross-sectional area and arranged in the wound portion; and a connection end portion having a magnetic-path cross-sectional area smaller than the magnetic-path cross-sectional area of the base portion and provided at an end portion of the base portion; and an outer core piece including a large-area portion having a magnetic-path cross-sectional area larger than the magnetic-path cross-sectional area of the base portion, the outer core piece being exposed from the wound portion, wherein the outer core piece has a relative permeability higher than a relative permeability of the inner core piece, and the resin mold portion includes a thick portion covering a connecting area between the connection end portion and the outer core piece, the thick portion being thicker than an area of the resin mold portion that covers the base portion.

The above-described reactor includes a resin mold portion that covers, at least partially, the inner core piece while exposing the wound portion, and thus, insulation properties between the wound portion and the inner core piece are improved by the inner resin portion. Also, in the case of cooling the reactor with a cooling medium such as a liquid coolant, the wound portion can be brought into direct contact with the cooling medium, and thus, the reactor has excellent heat dissipation. The outer core piece provided in the above-described reactor includes a large-area portion that has a magnetic-path cross-sectional area larger than that of the base portion of the inner core piece. Accordingly, heat can be readily released from the large-area portion, and the large-area portion can be readily brought into contact with the aforementioned cooling medium, compared with a case where the entire outer core piece has the same magnetic-path cross-sectional area as that of the base portion. For this reason as well, the above-described reactor has more excellent heat dissipation. If the surface area is larger due to the large-area portion being provided, more excellent heat dissipation is achieved.

In particular, in the above-described reactor, the resin mold portion has a thick portion provided at a position at which the resin mold portion covers the connecting area between the inner core piece and the outer core piece. This thick portion is thicker and is more unlikely to crack than an area (mainly, the inner resin portion) of the resin mold portion that covers the base portion of the inner core piece, and thus contributes to increasing the connection strength between the inner core piece and the outer core piece. Accordingly, with the above-described reactor, the magnetic core that is integrally held by the resin mold portion has better strength as an integrated body, and the reactor has excellent strength. If the thick portion continuously forms a ring-shape in the circumferential direction of the inner core piece, the reactor has more excellent strength. Also, since the above-described reactor locally has the thick portion, the reactor is smaller than that in a case where the entire resin mold portion is thick, but has excellent strength.

Furthermore, in the above-described reactor, the outer core piece has the large-area portion, but the connection end portion, which is locally thin, is provided in a region near an opening portion of a cylindrical gap between the wound portion and the inner core piece, and this configuration enables the molding material to be readily introduced into the cylindrical gap via the region near the opening portion. The connection end portion has a step portion on its outer-peripheral face, the step portion being not flush with an outer-peripheral face of the base portion of the inner core piece. Thus, when the above-described reactor is viewed from the axial direction of the wound portion, a gap between the inner-peripheral edge of the wound portion and the peripheral edge of the step portion at the connection end portion is larger than the cylindrical gap between the inner-peripheral face of the wound portion and the outer-peripheral face of the base portion of the inner core piece. A space around this connection end portion can be used as an introduction space, namely a space for introducing the molding material into the cylindrical gap. If the perimeter of the outer-peripheral face of the connection end portion is not flush the outer-peripheral face of the base portion of the inner core piece, the introduction space can be formed over the perimeter of the connection end portion, further facilitating introduction of the molding material. In a case of further narrowing the cylindrical gap as well, the introduction space can be formed in the region near the opening portion, and accordingly, the molding material can be readily introduced. Accordingly, with the above-described reactor, the molding material can be readily introduced into the cylindrical gap between the wound portion and the inner core piece, and the resin mold portion can be readily formed.

Moreover, with the above-described reactor, the relative permeability of the outer core piece is higher than the relative permeability of the inner core piece. For this reason, even if the connection end portion of the inner core piece that forms the connecting area between the inner core piece and the outer core piece is locally thin, leakage flux between these core pieces can be reduced. Accordingly, with the above-described reactor, an increase in loss caused by the leakage flux can be reduced, and thus, a low-loss reactor is achieved.

(2) An example of the above-described reactor may be a mode in which wherein the base portion includes an introduction groove that is open in an outer-peripheral face of the base portion and in an end face of the base portion.

The introduction groove in the above-described mode is open in a region of the end face of the base portion in which the aforementioned step portion is formed between the base portion and the connection end portion, and thus, a space is formed that is in communication with both the aforementioned introduction space and the cylindrical gap. If the perimeter of the overall outer-peripheral face of the connection end portion is not flush with the outer-peripheral face of the base portion of the base portion, the introduction groove is open in any region of the end face of the base portion and thus forms a space that is in communication with both the aforementioned introduction space and the cylindrical gap. In the above-described mode in which this introduction groove is provided, the molding material can be more readily introduced from the introduction space via the introduction groove into the cylindrical gap, and thus, the resin mold portion can be formed more readily. Also, the area of the resin mold portion that covers the introduction groove is provided continuously with the thick portion, and the thickness of this area that covers the introduction groove is larger than the thickness of the area that covers the base portion. Accordingly, in the above-described mode, many locally-thick portions are disposed in the resin mold portion in a region near the connecting area between the inner core piece and the outer core piece. This configuration further increases the connection strength between the inner core piece and the outer core piece, and achieves more excellent strength.

(3) An example of the above-described reactor may be a mode in which a protrusion protruding from an outer-peripheral face of the connection end portion.

In the above-described mode, the contact area of the thick portion with the connection end portion can be increased by the protrusion. Thus, the connection strength between the inner core piece and the outer core piece is further increased, and more excellent strength is achieved. Furthermore, in the above-described mode, the magnetic-path cross-sectional area of the connection end portion can be increased by the protrusion, and leakage flux between the inner core piece and the outer core piece can be reduced more readily.

(4) An example of the above-described reactor may be a mode in which wherein the inner core piece is a molded body of a composite material containing magnetic powder and resin.

The molded body of a composite material makes it possible to readily and accurately mold the inner core piece with an uneven shape that includes the base portion and the connection end portion that have different magnetic-path cross-sectional area, and that also includes the aforementioned protrusion and introduction groove. Accordingly, the above-described mode achieves excellent manufacturability of the inner core piece. Also, the molded body of a composite material can reduce the relative permeability if the filling factor of magnetic powder is lowered. If the relative permeability of the inner core piece is small to some extent (refer to (5) below), a magnetic core that does not have a magnetic gap can be obtained. With a magnetic core with a gapless structure, leakage flux caused by a magnetic gap does not substantially occur, and thus, the cylindrical gap can be made smaller. Accordingly, the above-described mode can further reduce loss that is based on leakage flux between the core pieces and leakage flux caused by a magnetic gap, and can reduce the size of the reactor due to the cylindrical gap being small. The aforementioned introduction space can be formed even if the cylindrical gap is small, and accordingly, the molding material can be readily introduced into the cylindrical gap, and the resin mold portion can be readily formed.

(5) An example of the above-described reactor may be a mode in which wherein the relative permeability of the inner core piece is 5 or more and 50 or less, and the relative permeability of the outer core piece is twice or more the relative permeability of the inner core piece.

In the above-described mode, the difference between the relative permeability of the outer core piece and the relative permeability of the inner core piece is large, and accordingly, leakage flux between the core pieces can be reduced more reliably. Depending on the aforementioned difference, the leakage flux can be substantially eliminated. Also, in the above-described mode, the relative permeability of the inner core piece is low, and accordingly, a magnetic core with a gapless structure can be obtained. Accordingly, the above-described mode can further reduce loss caused by leakage flux and further reduce the size of the reactor, as described in (4) above, and also enables the resin mold portion to be readily formed.

(6) An example of the above-described reactor according to (5) above may be a mode in which wherein the relative permeability of the outer core piece is 50 or more and 500 or less.

In the above-described mode, the relative permeability of the outer core piece satisfies the aforementioned specific range, in addition to (5) above. Accordingly, the difference between the relative permeability of the outer core piece and the inner core piece can be readily increased. The larger the difference is (e.g. by 100 or more), leakage flux between the core pieces can be reduced even if the connection end portion is further thinned. The thinner the connection end portion is, the larger the aforementioned introduction space is, and thus, the molding material can be readily introduced into the cylindrical gap, and the resin mold portion can be more readily formed.

(7) An example of the above-described reactor may be a mode in which wherein the connection end portion is exposed from the wound portion.

In the above-described mode, loss caused by leakage flux, such as copper loss, can be more readily reduced than in a case where the connection end portion is at least partially disposed in the wound portion. Furthermore, the connection end portion can be readily brought into contact with the outer core piece, and excellent assemblability of the inner core piece and the outer core piece is also achieved.

DETAILED DESCRIPTION OF EMBODIMENTS OF PRESENT DISCLOSURE

Hereinafter, embodiments of the present disclosure will be described in detail with reference to the drawings. The same reference numerals in the drawings refer to items with the same name.

Embodiment 1

A reactor 1 according to Embodiment 1 will be described with reference to FIGS. 1 to 3.

Figure 2A:
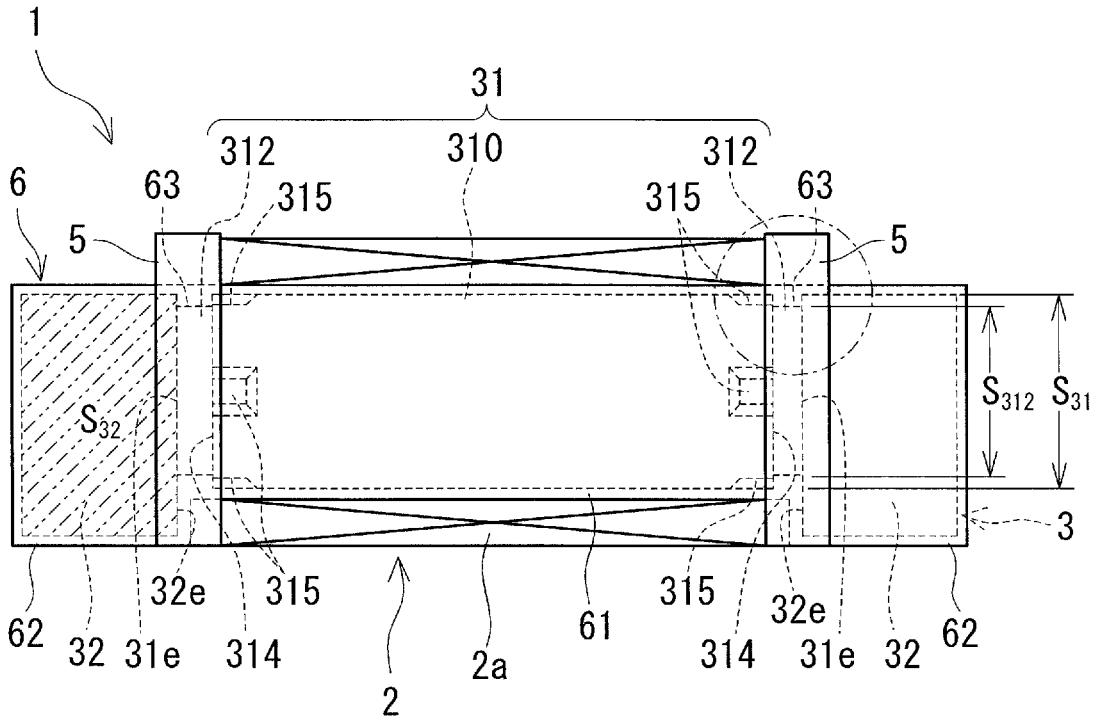
FIG. 2A is a schematic side view of the reactor according to Embodiment 1.
Figure 2B:
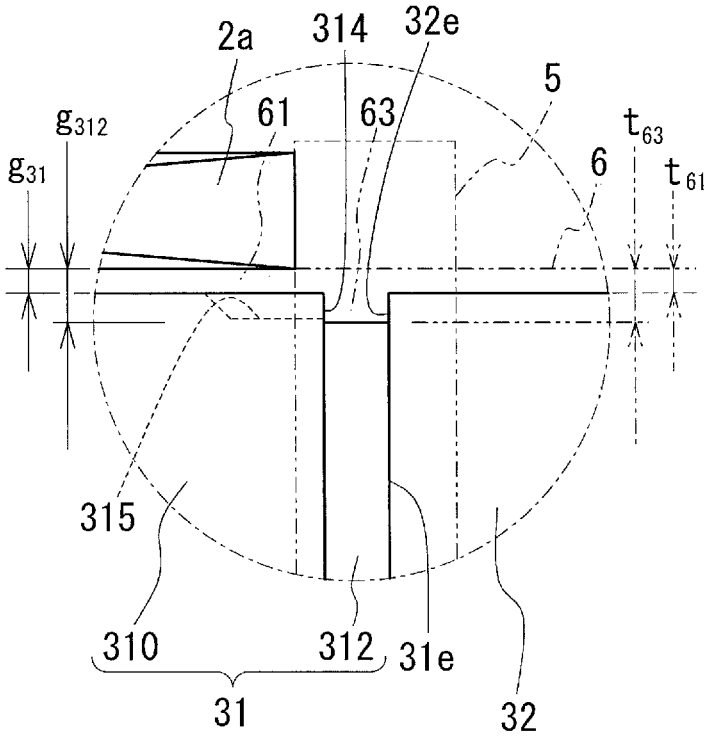
FIG. 2B is a partially-enlarged schematic side view of the reactor in FIG. 2A.

The following description will be given, assuming that the lower side refers to an installation side, i.e. the side on which the reactor 1 comes into contact with an installation target, and the upper side refers to the side opposite to the installation side. FIG. 2 shows, as an example, a case where the lower side of paper is the side on which the reactor 1 is installed. FIG. 2A shows a vertical cross-section of a wound portion 2*a* taken along a plane parallel to an axis direction thereof, and shows a state where an inner resin portion 61 is exposed. FIG. 2B shows a circled region indicated with a dash-dot line in FIG. 2A in an enlarged manner. FIG. 2B shows a region near a connecting area between an inner core piece 31 and an outer core piece 32 in an enlarged manner, and also virtually shows a resin mold portion 6 (resin mold) and an interposed member 5 with dash-double dot line lines.

Summary

The reactor 1 according to Embodiment 1 includes a coil 2, a magnetic core 3 that forms a closed magnetic circuit, and the resin mold portion 6, as shown in FIG. 1. In this example, the coil 2 has two wound portions 2*a* and 2*b*. The wound portions 2*a* and 2*b* are arranged side-by-side such that their axes are parallel to each other. The magnetic core 3 includes inner core pieces 31 that include base portions 310 (bases), which are disposed in the respective wound portions 2*a* and 2*b*, and outer core pieces 32 that are exposed from the wound portions 2*a* and 2*b*. The resin mold portion 6 includes inner resin portions 61 (inner resin) that are interposed between the wound portions 2*a* and 2*b* and the magnetic core 3 (here, the base portions 310). The resin mold portion 6 does not cover, but exposes outer-circumferential faces of the wound portions 2*a* and 2*b*. In the magnetic core 3 that is disposed inside and outside the wound portions 2*a* and 2*b*, the outer core pieces 32 are disposed so as to sandwich the inner core pieces 31, which are arranged side-by-side along the wound portions 2*a* and 2*b*, and the inner core pieces 31 and the outer core pieces 32 are fitted to form a ring shape. This reactor 1 is typically attached, when in use, to an installation target (not shown), such as a converter case.

In particular, in the reactor 1 according to Embodiment 1, connection end portions 312 (connection ends) of the inner core pieces 31 that serve as connecting areas between the inner core pieces 31 and the outer core pieces 32 are thinner than the base portion 310. The resin mold portion 6 includes thick portions 63 that cover the outer peripheries of the connection areas between the connection end portions 312, which are locally thin, and the outer core pieces 32. Due to the connection end portions 312 of the inner core pieces 31 being locally thin, before the resin mold portion 6 is formed, a space (introduction space $g_{312}$) larger than a cylindrical gap $g_{31}$ between the wound portion 2*a* (or 2*b*) and the base portion 310 is formed around the outer periphery of the connection end portion 312 in each connecting area between the core pieces 31 and 32, as shown in an enlarged manner in FIG. 2B. Furthermore, the outer core pieces 32 have a relative permeability larger than the relative permeability of the inner core pieces 31. With this reactor 1, the molding material can be readily introduced via the introduction space $g_{312}$ into the cylindrical gap $g_{31}$, and the resin mold portion 6 can be readily formed. Furthermore, excellent connection strength between the core pieces 31 and 32 is achieved by the thick portions 63, and leakage flux between the core pieces 31 and 32 can be reduced. Each constituent element will be described below in detail.

Coil

The coil 2 in this example includes the wound portions 2*a* and 2*b* that are cylindrical and are formed by helically winding wires. The following modes of the coil 2 that includes the two wound portions 2*a* and 2*b* arranged side-by-side are possible:

(α) a mode of the coil 2 that includes wound portions 2*a* and 2*b* that are formed with one continuous wire, and a connecting portion that is constituted by a portion of the wire spanning between the wound portions 2*a* and 2*b* and connects the wound portions 2*a* and 2*b* to each other; and (β) a mode of the coil 2 that includes wound portions 2*a* and 2*b* that are formed respectively with two independent wires, and a joint portion that is formed by joining an end portion, which is one of the two end portions that are pulled out of the wound portion 2*a*, to an end portion, which is one of the two end portions that are pulled out of the wound portion 2*b*, by means of welding, crimping, or the like.

In both modes, the end portions of the wires pulled out from the wound portions 2*a* and 2*b* (in the mode (β), the other end portions) are used as connecting portions to which an external device, such as a power supply, is connected.

Examples of the wires may include a coated wire that includes a conductive wire that is made of copper or the like, and an insulating coating that is made of a resin such as polyamideimide and covers the outer periphery of the conductive wire. The wound portions 2*a* and 2*b* in this example are edgewise coils that have a square-columnar shape and are formed by winding, edgewise, wires that are coated rectangular wires. The shape, size, and so on, of the wires and the wound portions 2*a* and 2*b* may be selected as appropriate. For example, the wires may be coated round wires, and the shape of the wound portions 2*a* and 2*b* may be a cylindrical shape, or a columnar shape that does not have corner portions, such as an oval shape or a race track shape. Also, the wound portions 2*a* and 2*b* may have different specifications.

In the reactor 1 according to Embodiment 1, the entire outer-peripheral faces of the wound portions 2*a* and 2*b* are not covered by the resin mold portion 6 and are exposed. Meanwhile, the inner resin portions 61, which are portions of the resin mold portion 6, are provided within the wound portions 2*a* and 2*b*, and inner-peripheral faces of the wound portions 2*a* and 2*b* are covered by the resin mold portion 6.

Magnetic Core

Summary

The magnetic core 3 in this example is integrally held due to the outer periphery thereof being covered by the resin mold portion 6, with the aforementioned four core pieces 31 and 32 fitted to formed a ring shape. This magnetic core 3 has a gapless structure in which a magnetic gap is substantially not included between the core pieces.

In the reactor 1 according to Embodiment 1, the cross-sectional area of a magnetic path ("magnetic-path cross-sectional area") of each of the inner core pieces 31 is not uniform over the overall length thereof, but partially varies. Specifically, each of the inner core pieces 31 includes a base portion 310 that has a predetermined magnetic-path cross-sectional area $S_{31}$, and connection end portions 312, each of which has a magnetic-path cross-sectional area $S_{312}$ smaller than the magnetic-path cross-sectional area $S_{31}$ of the base portion 310 (refer also to FIG. 3). The connection end portions 312 are provided at end portions of the base portion 310. Each of the inner core pieces 31 in this example has the connection end portions 312 at two ends of the base portion 310. These portions are integrally molded, and each inner core piece 31 has a step-like shape with an intermediate portion in the axial direction thereof being relatively thick and the two end portions being relatively thin (FIG. 3).

With the coil 2 and each inner core piece 31 fitted to each other, the base portion 310 is disposed in the wound portion 2*a* (or 2*b*). In this example, the connection end portions 312 at two ends of the base portion 310 are disposed so as to be exposed from the wound portion 2*a* (or 2*b*) and protrude from end faces of the wound portion 2*a* (or 2*b*) (FIG. 2A). With the coil 2 and the magnetic core 3 fitted together, as shown in FIG. 2B, grooves are formed by the end faces 314 of the base portions 310, outer-peripheral faces of the connection end portions 312, and inner end faces 32*e* of the outer core pieces 32. In this example, ring-shaped grooves are formed that are continuous along the outer peripheries of the connection end portions 312. These ring-shaped grooves serve as areas for forming the thick portions 63 of the resin mold portion 6.

The inner core pieces 31 and the outer core pieces 32 will be described below in this order.

Inner Core Piece

In this example, both the portion of the magnetic core 3 that is disposed in the wound portion 2*a* and the portion that is disposed in the wound portion 2*b* are mainly constituted by one columnar inner core piece 31 (FIG. 1). End faces 31*e* of one inner core piece 31 are joined to the inner end faces 32*e* of the outer core pieces 32 (FIG. 2A). Note that, in this example, later-described interposed members 5 are disposed at seam areas between the core pieces 31 and 32.

The inner core pieces 31 in this example have the same shape and the same size. Specifically, each of the inner core pieces 31 has a rectangular-parallelepiped shape as shown in FIG. 3, and has the connection end portions 312 so as to sandwich the base portion 310. The base portion 310 has a relatively large magnetic-path cross-sectional area $S_{31}$, and, in this example, the base portion 310 has a length that is substantially equal to the length of the wound portion 2*a* (or 2*b*) (FIG. 1). Each of the connection end portions 312 has a relatively small magnetic-path cross-sectional area $S_{312}$, and is shorter than the base 310. The shapes of the base portion 310 and the connection end portions 312 may be changed as appropriate, and may be a polygonal columnar shape such as a cylindrical shape or hexagonal columnar shape, for example. In the case of employing a rectangular columnar shape or the like, corner portions may be C-chamfered, or may be R-chamfered as shown in FIG. 3. As a result of the corner portions being chamfered, a crack is unlikely to occur, and excellent strength is achieved. In addition, it is possible to achieve a reduction in the weight of the inner core piece 31 and an increase in the contact area between the inner core piece 31 and the inner resin portion 61. In addition, although, in this example, both the base portion 310 and the connection end portions 312 have a rectangular-parallelepiped shape with the outer shapes of the end face 31*e* and 314 being substantially similar to each other, the base portion 310 and the connection end portions 312 may be columnar bodies with different outer shapes. For example, if the connection end portions 312 have a gear-like shape or the like, the contact area between the connection end portions 63 and the thick portions 63 can be increased, and the connection strength between the core pieces 31 and 32 can be increased.

The base portion 310 in this example has a predetermined magnetic-path cross-sectional area $S_{31}$ over the overall length thereof, excluding a region in which introduction grooves 315 (the details of which will be described later) are formed. Thus, the magnetic core 3 can secure a sufficient portion with the magnetic-path cross-sectional area $S_{31}$ and have predetermined magnetic characteristics. FIG. 3 virtually shows the magnetic-path cross-sectional area $S_{31}$ of the base portion 310.

The connection end portions 312 protrude from the end faces 314 of the base portion 310. The connection end portions 312 in this example are columnar bodies with a uniform magnetic-path cross-sectional area $S_{312}$ over the overall length thereof, including the end faces 31*e* that are connected to the inner end faces 32*e* of the outer core pieces 32. Due to the magnetic-path cross-sectional area $S_{31}$ of the base portion 310 differing from the magnetic-path cross-sectional area $S_{312}$ of the connection end portions 312, the profile lengths of the base portion 310 and each connection end portion 312 also differ from each other. Spaces (introduction spaces $g_{312}$) formed at step portions that are formed due to this difference in length are used as guiding areas for guiding the molding material into the cylindrical gaps $g_{31}$ between the wound portions 2*a* and 2*b* and the inner core pieces 31 when the resin mold portion 6 is formed. Also, the introduction spaces $g_{312}$ are used as areas for forming the thick portions 63 (FIG. 2B).

By adjusting the size of the aforementioned step portions, the ease of introducing the molding material into the cylindrical gaps $g_{31}$ and the size of the thick portions 63 can be adjusted. For example, the larger the step height of the aforementioned step portions is, or the larger the width of the step portions is, the more the size of the introduction spaces $g_{312}$ can be increased, and it is possible to increase the ease of introduction and increase the thickness and the width of the thick portions 63. Also, the length of the step portions to be formed differs depending on the outer shape of the connection end portions 312, the positions at which the connection end portions 312 are formed with respect to the end faces 314 of the base portion 310, and so on, and the perimeters of the introduction spaces 312 and the thick portions 63 also differ. For example, if the position at which each connection end portion 312 is formed is adjusted such that a portion of the outer periphery of the connection end portion 312 is flush with the outer periphery of the corresponding base portion 310, a step is provided only at a portion of the outer-peripheral face of the connection end portion 312. If, as in this example, the outer shape of each connection end portion 312 is made similar to that of the end faces 314, and the connection end portions 312 are provided coaxially with the corresponding base portion 310, the steps are provided over the perimeters of the connection end portions 312. As a result, the introduction spaces $g_{312}$ and the thick portions 63 that have uniform respective thicknesses are provided to form a ring shape. It is favorable that thick portions 63 that are thicker and wider and have a ring shape are provided, since the connection strength between the core pieces 31 and 32 can thus be further increased. Note that the step height refers to the length in a direction orthogonal to the axial direction of the inner core pieces 31 (that is, here, equal to the axial direction of the wound portions 2*a* and 2*b*). The width of the step portions refers to a length in the axial direction of the inner core pieces 31. Here, the aforementioned width corresponds to the protrusion length, namely the length by which the connection end portions 312 protrude from the end faces 314 of the corresponding base portion 310.

Regarding the aforementioned length of the step portions, the smaller the magnetic-path cross-sectional area $S_{312}$ of the connection end portions 312 is, the more the step height can be increased. Alternatively, the larger the protrusion length of the connection end portions 312 is, the more the width of the step portions can be increased. However, if the magnetic-path cross-sectional area $S_{312}$ is too small, or the protrusion height is too large, the ratio of the portion of the magnetic core 3 that has the magnetic-path cross-sectional area $S_{312}$ smaller than the magnetic-path cross-sectional area $S_{31}$ is large. Thus, the magnetic core 3 may become more likely to be magnetically saturated, and leakage flux from the connection end portions 312 may increase. Considering the ease of introduction, the connection strength, magnetic characteristics such as magnetic saturation and leakage flux, and so on, it is conceivable, as an example, that the magnetic-path cross-sectional area $S_{312}$ of the connection end portions 312 is 60% or more and less than 100% of the magnetic-path cross-sectional area $S_{31}$ of the base portion 310, or furthermore, 65% or more and 98% or less, or 70% or more and 95% or less. Alternatively, it is conceivable, as an example, that the step height is 0.1 mm or more and 2 mm or less, or furthermore, 0.5 mm or more and 1.5 mm or less, or 1.2 mm or less. Also, it is conceivable, as an example, that the width (protrusion length) of the step portions is 1% or more and 35% or less of the length of the wound portions 2*a* and 2*b*, or furthermore, 5% or more and 20% or less, or 15% or less.

Each of the connection end portions 312 can be provided with protrusions 317 that protrude from its outer-peripheral face. FIG. 3 virtually shows the protrusions with dash-double dot lines. If the protrusions 317 are provided, the contact area between the connection end portions 312 and the thick portions 63 can be increased, and the connection strength between the core pieces 31 and 32 can be increased, compared with a case where the outer-peripheral faces of the connection end portions 312 are smooth faces. Although FIG. 3 shows, as an example, a case where a plurality of hemispherical protrusions 317 are disposed in a staggered arrangement, the shape, size, number, disposal state, and so on, of the protrusions 317 may be changed as appropriate. The larger the number of protrusions 317 is, the more the contact area between the connection end portions 312 and the thick portions 63 can be increased.

Note that the connection end portions 312 can be provided with recessed portions (not shown) in place of, or in addition to, the protrusions 317. It is preferable that the connection end portions 312, which have the magnetic-path cross-sectional area $S_{312}$, are provided with the protrusions 317, rather than recessed portions. This is because, with the protrusions 317, an increase in the magnetic-path cross-sectional area of the connection end portions 312 can be expected. This is also because it is possible to prevent the magnetic-path cross-sectional area of the connection end portions 312 from locally decreasing due to the recessed portions, and leakage flux at the connection end portions 312 can be readily reduced.

In the inner core pieces 31, the base portion 310 can also be provided with introduction grooves 315, in addition to the connection end portions 312. The introduction grooves 315 are open in the end faces 314 of the base portion 310 and the outer-peripheral face of the base portion 310, and form spaces that are in communication with both the introduction spaces $g_{312}$ and the cylindrical gaps $g_{31}$. For this reason, when the resin mold portion 6 is formed that covers the magnetic core 3 while exposing the coil 2, if the molding material is supplied from the outer core piece 32 sides toward the coil 2 side, the molding material can be readily introduced from the introduction spaces $g_{312}$ via the introduction grooves 315 into the cylindrical gaps $g_{31}$ (refer also to FIG. 2B). Furthermore, areas of the resin mold portion 6 that cover the introduction grooves 315 are formed to have a thickness larger than the thickness $t_{61}$ of the area that covers the base portion 310, and are continuous with the thick portions 63. Accordingly, the resin mold portion 6 is provided with more locally-thick areas in regions near the connecting areas between the core pieces 31 and 32, and the connection strength between the core pieces 31 and 32 can be further increased.

The shape (opening shape, cross-sectional shape, etc.), size (depth, opening width, length (length in the axial direction of the base portion 310) etc.), number, forming positions, and so on, of the introduction grooves 315 may be selected as appropriate. The larger the introduction grooves 315 are, or the larger the number of introduction grooves 315 is, the more the ease of introducing the molding material and the connection strength between the core pieces 31 and 32 can be increased. However, if the introduction grooves 315 are too large, or the number of introduction grooves 315 is too large, the ratio of the portion with the magnetic-path cross-sectional area $S_{31}$ is small. For this reason, the magnetic core 3 may become likely to be magnetically saturated, or leakage flux from regions near the introduction grooves 315 may increase. Considering the ease of introduction, the connection strength, magnetic characteristics such as magnetic saturation and leakage flux, and so on, it is conceivable, as an example, that the size of the introduction grooves 315 is adjusted such that the magnetic-path cross-sectional area of the areas of each base portion 310 in which the introduction grooves 315 are formed satisfies $S_{312}$ or more and $S_{31}$ or less. It is conceivable, as an example, that the length of each introduction groove 315 is a length smaller than or equal to five turns of the coil 2, or furthermore, a length that is smaller than or equal to two turns of the coil 2. If, as in this example, the perimeters of the outer-peripheral faces of the connection end portions 312 are not flush with the outer-peripheral face of the corresponding base portion 310, the introduction grooves 315 can be open at any position on the end faces 314 of the base portion 310, and a high degree of freedom of the forming positions is achieved.

It is favorable that the opening portions of the introduction grooves 315 are provided in regions of the outer-peripheral face of each base portion 310 that are distant from regions (hereinafter referred to as inner regions) where adjacent inner core pieces 31 oppose each other. Magnetic flux is likely to pass through the aforementioned inner regions, compared with regions of the adjacent inner core pieces 31 that are disposed on the sides distant from each other. If the introduction grooves 315 that are open in the inner regions are provided, leakage flux from regions near the introduction grooves 315 may increase.

Figure 3:
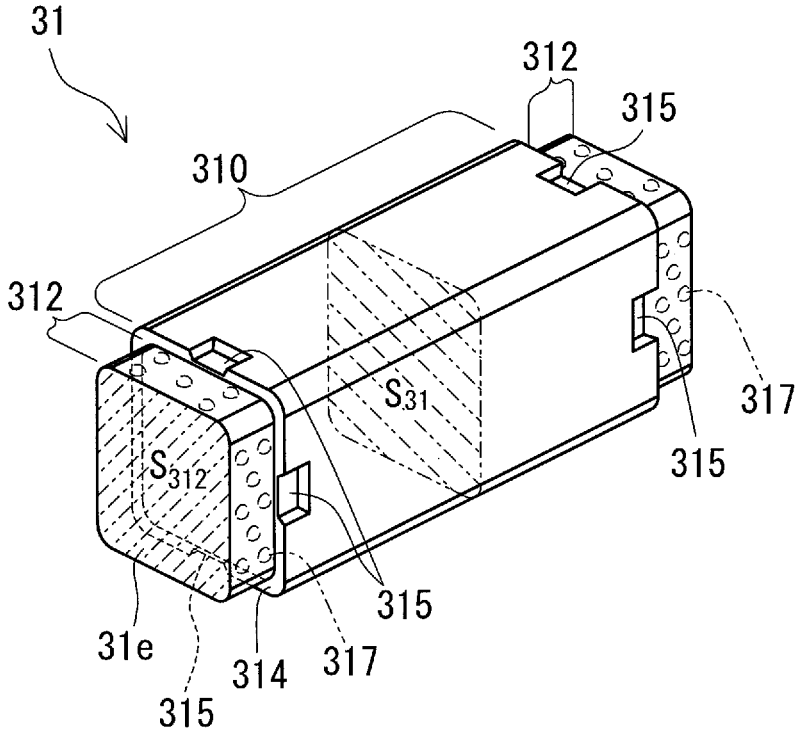
FIG. 3 is a schematic perspective view of an inner core piece that is included in the reactor according to Embodiment 1.

This example describes an example in which the introduction grooves 315 are provided that are open in three faces of each end portion of the base portion 310 of one inner core piece 31 (in FIGS. 2A and 3, upper and lower faces, and an outer face located on the paper proximal side), i.e. faces excluding faces that correspond to the inner regions (in FIG. 1, inner faces of adjacent base portions 310 that oppose each other; in FIG. 3, faces that are on the paper distal side and are not visible). That is to say, one inner core piece 31 is provided with a total of six introduction grooves 315 at two end portions of the base portion 310. The introduction grooves 315 have the same shape and the same size, and the opening shape thereof is a rectangular shape. In this example, each of the introduction grooves 315 includes a groove bottom face that is substantially parallel to the outer periphery of the corresponding base portion 310, and an inclined face that intersects the groove bottom face and reaches the outer-peripheral face from the groove bottom face. The inclined face inclines such that the groove depth is shallower as it extends away from the end face 314. Accordingly, the inclined face contributes to enabling the molding material to more readily flow from the introduction groove 315 into the corresponding cylindrical gap $g_{31}$.

The inner core pieces 31 in this example have the same shape and the same size. If the inner core pieces 31 have the same shape and the same size, the core pieces can be manufactured using the same mold, and conditions can be readily adjusted when the resin mold portion 6 is formed. Accordingly, excellent manufacturability is achieved by employing the same shape and the same size of the inner core pieces 31. In addition, the shapes and the sizes of the connection end portions 312 may differ between the inner core pieces 31, or the shapes and the sizes of the connection end portions 312 of one inner core piece 31 may differ. For example, a mode is conceivable in which the connection end portion 312 is provided only at one end of each inner core piece 31, and is not provided at the other end.

Outer Core Piece

In this example, both the portion of the magnetic core 3 that is disposed outside the wound portion 2*a* and the portion that is disposed outside the wound portion 2*b* are mainly constituted by one columnar outer core piece 32 (FIG. 1). Each of the outer core piece 32 has a large-area portion that has a magnetic-path cross-sectional area $S_{32}$ larger than the magnetic-path cross-sectional area $S_{31}$ of the base portion 310 of each inner core piece 31. FIG. 2 virtually shows the magnetic-path cross-sectional area $S_{32}$ of an outer core piece 32.

The outer core pieces 32 in this example have the same shape and the same size, and have a rectangular-parallelepiped shape as shown in FIGS. 1 and 2A. One face (inner end face 31*e*) of each outer core piece 32 is used as a face to which the inner core pieces 31 are joined. As shown in FIG. 2A, each of the outer core pieces 32 in this example has a lower face, which is on the installation side thereof, further protrudes toward an installation target side than the lower faces of the base portions 310 of the inner core pieces 31 that is the installation side thereof, and has an upper face on the opposite side that is flush with the upper faces of the base portions 31. Each of these outer core pieces 32 have a magnetic-path cross-sectional area that is larger than or equal to the magnetic-path cross-sectional area $S_{31}$ of each base portion 310, and thus, leakage flux can be readily reduced. Each outer core piece 32 in this example has the magnetic-path cross-sectional area $S_{32}$ ($>S_{31}$) over the entirety thereof, and forms a large-area portion as a whole. Note that, if each outer core piece 32 partially has a large-area portion that has the magnetic-path cross-sectional area $S_{32}$, the outer core piece can include a portion that has a magnetic-path cross-sectional area equal to the magnetic-path cross-sectional area $S_{31}$.

The shape of the outer core pieces 32 can be changed as appropriate. For example, it is conceivable, as an example, that each of the outer core pieces 32 has a shape with outer corner portions that are C-chamfered or R-chamfered greatly, to some extent, e.g. has a trapezoidal shape or a doom shape in a plan view (top view). In a plan view, the outer corner portions of the outer core pieces 32 that are distant from the wound portions 2*a* and 2*b* are in a region through which magnetic flux hardly passes, and thus, magnetic characteristics are unlikely to deteriorate even if the corner portions are chamfered as mentioned above. Also, due to the corner portions being chamfered, a reduction in the weight of the outer core pieces 32 and an increase in the contact area between the outer core pieces 32 and the outer resin portions 62 can be achieved.

Assembly State

The end faces 31*e* of the inner core pieces 31 and the inner end faces 32*e* of the outer core pieces 32 are connected to each other to assemble the magnetic core 3. When viewed, in this state, in the axial direction of the wound portions 2*a* and 2*b* from an outer end face 32*o* (FIG. 1) of each outer core piece 32 (i.e. when viewed from the front), the end faces 314, and 31*e* of the inner core pieces 31 overlap the outer core pieces 32 and are not visible. Each of the outer core pieces 32 in this example has an area of the inner end face 32*e* that is larger than the total area ($2\times S_{31}$) of the end faces 314 of the inner core pieces 31. Moreover, the magnetic core 3 is assembled such that the outer-peripheral faces (in FIG. 1, upper and lower faces) of the outer core pieces 32 and the outer-peripheral faces (aforementioned outer faces) of the base portions 310 of the two inner core pieces 31 are flush with each other.

However, before the resin mold portion 6 is formed, the introduction spaces $g_{312}$, each of which is larger than the corresponding cylindrical gap $g_{31}$, are formed in the outer peripheries of the connection end portions 312 of the inner core pieces 31. In this example, the connection end portions 312 protrude from the end faces of the wound portion 2*a* (or 2*b*), the introduction spaces $g_{312}$ can be formed between the end faces of the wound portion 2*a* (or 2*b*) and the inner end faces 32*e* of the outer core pieces 32*e* (FIG. 2B). Accordingly, if the molding material is supplied from the outer end face 32*o* (FIG. 1) sides of the outer core pieces 32, the molding material can be introduced via the outer-peripheral faces of the outer core pieces 32 into the introduction spaces $g_{312}$. Furthermore, the molding material can be introduced via the introduction spaces $g_{312}$ into the cylindrical gaps $g_{31}$. In this example, the molding material can be introduced from the perimeters of the outer peripheries of the connection end portions 312 into the cylindrical gaps $g_{31}$. Note that, if the inner core pieces 31 and the outer core pieces are fitted to each other such that the entire outer-peripheral faces of the connection end portions 312 are not flush with the outer-peripheral faces of the corresponding base portions 310, and the outer-peripheral faces of the outer core pieces 32 are flush with the outer-peripheral faces of the connection end portions 312 of the inner core pieces 31 (in FIG. 2B, if a state is entered where the upper faces of the outer core pieces 32 are lowered downward), the molding material can be more readily caused to flow from the outer core piece 32 sides into the introduction spaces $g_{312}$.

Characteristics

The relative permeability of the outer core pieces 32 is higher than the relative permeability of the inner core pieces 31. For this reason, even if the magnetic-path cross-sectional area $S_{312}$ of the connection end portion 312 of each inner core piece 31 that serves as the connecting area between the inner core piece 31 and one outer core piece 32 is smaller than the magnetic-path cross-sectional area $S_{31}$ of the base portion 310, leakage flux between the core pieces 31 and 32 can be reduced. The reactor 1 that includes these core pieces 31 and 32 that have different relative permeabilities can reduce loss caused by the aforementioned leakage flux, and is a low-loss reactor.

The relative permeability here is obtained as follows. A ring-shaped measurement sample (outer diameter: 32 mm; inner diameter: 20 mm; and thicknesses: 5 mm) that has the same composition as that of the core pieces 31 and 32 is prepared. Then, a wire is wound around the measurement sample with 300 turns on a primary side and 300 turns on a secondary side, and a B-H initial magnetization curve is measured in a range of H=0 (Oe) to 100 (Oe). The largest value of B/H of the obtained B-H initial magnetization curve is obtained, and this largest value is regarded as a relative permeability. The magnetization curve here refers to a so-called DC magnetization curve.

If the relative permeability of the outer core pieces 32 is larger than the relative permeability of the inner core pieces 31, and the difference between these relative permeabilities is larger, leakage flux between the core pieces 31 and 32 can be further reduced. In particular, if the relative permeability of the outer core pieces 32 is twice or more the relative permeability of the inner core pieces 31, leakage flux between the core pieces 31 and 32 can be reduced more reliably. If the aforementioned difference is larger, e.g. if the relative permeability of the outer core pieces 32 is 2.5 times or more the relative permeability of the inner core pieces 31, or furthermore, three times or more, five times or more, or 10 times or more, the aforementioned leakage flux can be more readily reduced. Favorably, the leakage flux can be substantially eliminated.

The relative permeability of the inner core pieces 31 may be, for example, 5 or more and 50 or less. The relative permeability of the inner core pieces 31 may be 10 or more and 45 or less, or furthermore, 40 or less, 35 or less, or 30 or less, and may be reduced further. The magnetic core 3 that includes the inner core pieces 31 with such low permeability is unlikely to be magnetically saturated, and thus, a gapless structure that does not have a magnetic gap can be made. Since leakage flux caused by a magnetic gap does not substantially occur in the magnetic core 3 with the gapless structure, the size of the cylindrical gaps $g_{31}$ can be reduced, and thus, a smaller reactor 1 can be obtained. The introduction spaces $g_{312}$ can be formed as mentioned above even if the cylindrical gaps $g_{31}$ are small, and thus, the molding material can be readily introduced into the cylindrical gaps $g_{31}$, and the resin mold portion 6 can be readily formed.

The relative permeability of the outer core pieces 32 may be, for example, 50 or more and 500 or less. The relative permeability of the outer core pieces 32 may be 80 or more, or furthermore, 100 or more (twice or more when the relative permeability of the inner core pieces 31 is 50), 150 or more, or 180 or more, and can be thus increased. With the outer core pieces 32 with such high permeability, the difference from the relative permeability of the inner core pieces 31 can be readily increased. For example, the relative permeability of the outer core pieces 32 can be made twice or more the relative permeability of the inner core pieces 31.

Thus, even if the connection end portions 312 of the inner core pieces 31 are made smaller (thinner), leakage flux between the core pieces 31 and 32 can be reduced. Furthermore, the thinner the connection end portions 312 are, the more the introduction spaces $g_{312}$ can be increased, and thus, the molding material can be more readily introduced into the cylindrical gaps $g_{31}$.

Material

Examples of the inner core pieces 31 and the outer core pieces 32 that constitute the magnetic core 3 may include molded bodies that contain a soft magnetic material, such as any of soft magnetic metals including iron, and an iron alloy (Fe—Si alloy, Fe—Ni alloy etc.). Specific examples of each core piece may include: a resin core piece that is a molded body made of a composite material containing magnetic powder, such as soft magnetic material powder or coated powder that includes insulating coating, and resin; a green compact core piece that is a green compact molded body formed by compacting and molding the magnetic powder; a ferrite core piece that is a sintered body of a soft magnetic material; a steel core piece that is a laminated body formed by laminating soft magnetic metal plates, such as electromagnetic steel plates; and the like. For example, if the magnetic core 3 is in a mixed mode containing a plurality of types of core pieces that are selected from a group including the aforementioned resin core pieces, green compact core pieces, ferrite core pieces, and steel core pieces, the inner core pieces 31 and the outer core pieces 32 that have different relative permeabilities can be readily provided. Alternatively, the magnetic core 3 may be in a mode of including only resin core pieces as the core pieces. With resin core pieces, the relative permeability can be readily varied depending on the composition of magnetic powder and the content thereof. The composition and the content of magnetic powder may be adjusted such that the inner core pieces 31 and the outer core pieces 32 have predetermined respective relative permeabilities.

The content of the magnetic powder in the aforementioned composite material that constitutes a resin core piece is, for example, 30 volume % or more and 80 volume % or less, and the content of the resin is, for example, 10 volume % or more and 70 volume % or less. From the viewpoint of an increase in saturation magnetic flux density and heat dissipation, the content of the magnetic powder may be 50 volume % or more, or furthermore, 55 volume % or more, or 60 volume % or more. From the viewpoint of an increase in the fluidity during the manufacturing process, the content of the magnetic powder may be 75 volume % or less, or furthermore, 70 volume % or less, and the content of the resin may be more than 30 volume %.

Examples of the resin in the aforementioned composite material may include thermosetting resin, thermoplastic resin, cold setting resin, low-temperature setting resin, and the like. Examples of the thermosetting resin may include unsaturated polyester resin, epoxy resin, urethane resin, silicone resin, and the like. Examples of the thermoplastic resin may include polyphenylene sulfide (PPS) resin, polytetrafluoroethylene (PTFE) resin, crystal polymer (LCP), polyamide (PA) resin such as nylon 6 or nylon 66, polybutylene terephthalate (PBT) resin, acrylonitrile-butadiene-styrene (ABS) resin, and the like. In addition, BMC (bulk molding compound), which is obtained by mixing calcium carbonate or glass fiber with unsaturated polyester, millable silicone rubber, millable urethane rubber, and the like, may also be used.

Heat dissipation can be further enhanced if the above composite material contains non-magnetic, non-metal powder (filler) such as alumina or silica powder, in addition to the magnetic powder and the resin. The content of the non-magnetic, non-metal powder may be, for example, 0.2 mass % or more and 20 mass % or less, or furthermore, 0.3 mass % or more and 15 mass % or less, or 0.5 mass % or more and 10 mass % or less.

A molded body of the aforementioned composite material can be manufactured using an appropriate molding method, such as injection molding or cast molding. With resin core pieces, if the filling factor (content) of magnetic powder is lowered during the manufacturing process, the relative permeability can be readily reduced. For example, the relative permeability of resin core pieces may be 5 or more and 50 or less.

Examples of the aforementioned green compact molded body may include, typically, a green compact molded body obtained by compressing and molding mixed powder that contains magnetic powder and a binder into a predetermined shape, and furthermore, a green compact molded body obtained by performing heat treatment after molding. The binder may be resin or the like, and the content thereof may be, for example, 30 volume % or less. If heat treatment is performed, the binder may disappear or may be thermally denatured. With the green compact molded body, the content of magnetic powder can be more readily increased (e.g. to more than 80 volume %, or furthermore, 85 volume % or more) than a composite material molded body, and a core piece with a higher saturation magnetic flux density and relative permeability can be more readily obtained. For example, the relative permeability of green compact core pieces may be 50 or more and 500 or less.

The inner core pieces 31 in this example are resin core pieces, and the outer core pieces 32 are green compact core pieces. Also, in this example, the relative permeability of the inner core pieces 31 is 5 or more and 50 or less. Meanwhile, the relative permeability of the outer core pieces 32 is 50 or more and 500 or less, and is twice or more the relative permeability of the inner core pieces 31.

Interposed Members

The reactor 1 in this example further includes interposed members 5 that are interposed between the coil 2 and the magnetic core 3. The interposed members 5 are typically made of an insulating material, and function as insulating members between the coil 2 and the magnetic core 3, and members for positioning the inner core pieces 31 and the outer core pieces 32 with respect to the wound portions 2*a* and 2*b*, for example. The interposed members 5 in this example are members with a rectangular frame shape within which the seam areas between the inner core pieces 31 and the outer core pieces 32 and a region around the seam areas are disposed. These interposed members 5 also function as members that form flow paths for the molding material when the resin mold portion 6 is formed.

For example, each of the interposed members 5 includes open holes, a support portion, a coil groove portion, and a core groove portion (see an outer interposed portion 52 described in JP 2017-135334A for an interposed member with a similar shape), which are described below. The open holes penetrate the interposed member 5 from the sides on which the outer core pieces 32 are disposed (hereinafter referred to as "outer core side") to the side on which the wound portions 2*a* and 2*b* are disposed (hereinafter referred to as "coil side"). The inner core pieces 31 are inserted into the open holes. The support portion partially protrudes from an inner-peripheral face that forms the open holes, and supports portions (in this example, four corner portions of the base portion 310) of each inner core piece 31. The coil groove portion is provided on the coil side of each interposed member 5, and end faces and regions therearound of the wound portions 2*a* and 2*b* are fitted into the coil groove portion. The core groove portion is provided on the outer core side of the interposed member 5, and inner end faces 32*e* and regions therearound of an outer core piece 32 are fitted into the core groove portion.

In a case where these interposed members 5 are provided, the wound portions 2*a* and 2*b* are fitted into the coil groove portions, the inner core pieces 31 are inserted into the respective open holes, and the end faces 31*e* of the inner core pieces 31 come into contact with the inner end faces 32*e* of the outer core pieces 32 that are fitted into the core groove portions. In this state, the shape and the size of the interposed members 5 are adjusted such that the flow paths for the molding material are provided. To provide a flow path for the molding material, for example, it is conceivable to provide gaps provided between areas of the inner core pieces 31 that are not supported by the support portion and the inner-peripheral face of the open holes, and between the outer core pieces 32 and the core groove portions. The flow path for the molding material is provided such that the molding material does not leak onto the outer-peripheral faces of the wound portions 2*a* and 2*b*. As long as the interposed members 5 have the aforementioned functions, the shape, size, and the like of the interposed members 5 may be selected as appropriate, and a known configuration may be referenced.

In this example, the interposed members 5 support a portion of the base portion 310 of each inner core piece 31 using the support portions and support the wound portions 2*a* and 2*b* using inner faces of the coil groove portions. The open holes and the coil groove portions are provided so as to form the cylindrical gap $g_{31}$ between the wound portion 2*a* (or 2*b*) and the corresponding base portion 310. Also, open holes are provided so as to form the introduction space $g_{312}$ between the outer-peripheral face of the connection end portions 312 and a portion of an inner-peripheral face of each open hole. By supporting a portion of the inner end face 32*e* of each outer core piece 32 using a groove bottom face of each core groove portion, the core groove portion is provided so as to form a gap between the outer-peripheral face of the outer core piece 32 and the inner-peripheral face of the core groove portion. In a state where the interposed members 5, which have the open holes, the coil groove portions, and the core groove portions, the coil 2, and the magnetic core 3 are fitted together, spaces are provided that are in communication with the cylindrical gaps $g_{31}$ from gaps around the outer core pieces 32 via the introduction spaces $g_{312}$ (same). These spaces in communication are used flow paths for the molding material.

Examples of the constituent material of the interposed members 5 may include an insulating material, such as any of various resins. For example, any of the various thermoplastic resins and thermosetting resins described in the section of the composite material that constitute the resin core pieces may be used. The interposed members 5 can be manufactured using any known molding method, such as injection molding.

Resin Mold Portion

Summary

The resin mold portion 6 has a function of covering the outer periphery of at least one of the core pieces that constitute the magnetic core 3, thus protecting the core pieces from the external environment, mechanically protecting the core pieces, and enhancing insulation properties between the core pieces and components surrounding the coil 2. The resin mold portion 6 in this example does not cover the outer-peripheral faces of the wound portions 2*a* and 2*b*, and exposes the wound portions 2*a* and 2*b*. Thus, for example, the wound portions 2*a* and 2*b* can be brought into direct contact with a cooling medium such as a liquid coolant, and thus, heat dissipation of the reactor 1 can thus be enhanced.

The resin mold portion 6 includes the thick portions 63 that cover the connecting areas between the inner core pieces 31 and the outer core pieces 32, in addition to the inner resin portions 61 that cover the outer peripheries of portions of the inner resin portions 31 that are accommodated in the wound portions 2*a* and 2*b*. The resin mold portion 6 in this example further includes outer resin portions 62 that cover the outer peripheries of the outer core pieces 32, and is an integrated body obtained as a result of these members being continuously formed. This resin mold portion 6 integrally holds an assembled set of the magnetic core 3 and the interposed members 5.

The inner resin portions 61, the outer resin portions 62, and the thick portions 63 will be described below in this order.

Inner Resin Portions

Each of the inner resin portions 61 in this example is a cylindrical body that is formed due to the constituent resin of the resin mold portion 6 being charged into a cylindrical gap $g_{31}$ (here, a square-cylindrical space) between the inner-peripheral face of the wound portion 2*a* (or 2*b*) and the outer-peripheral face of the base portion 310 of the corresponding inner core piece 310. In this example, each of the inner resin portions 61 has a thickness $t_{61}$ (FIG. 1) that is substantially uniform over the overall length of the inner resin portion 61, excluding portions that cover the introduction grooves of the base portion 310. If the magnetic core 3 has a gapless structure as in this example, the size of each cylindrical gap $g_{31}$ can be reduced, and the thickness $t_{61}$ of each inner resin portion 61 can be reduced in accordance with the size of the cylindrical gap $g_{31}$ (FIG. 2B). The thickness $t_{61}$ of the inner resin portion 61 may be selected as appropriate, and may be, for example, 0.1 mm or more and 4 mm or less, or furthermore, 0.3 mm or more and 3 mm or less, or furthermore, 2.5 mm or less, 2 mm or less, or 1.5 mm or less. The thickness of the portions of each inner resin portion 61 that covers the introduction grooves 315 is larger than the aforementioned thickness $t_{61}$ by the depth of the introduction grooves 315.

Outer Resin Portions

The outer resin portions 62 in this example cover, along the outer core pieces 32, the substantially entire outer-peripheral faces of the outer core pieces 32 excluding the inner end faces 32*e* to which the inner core pieces 31 are connected and regions therearound, and have a substantially uniform thickness. The regions of the outer resin portions 62 that cover the outer core pieces 32, the thickness of these regions, and so on, may be selected as appropriate. The thickness of the outer resin portions 62 may be equal to the thickness $t_{61}$ of the inner resin portions 61, or may differ from the thickness $t_{61}$, for example.

Thick Portions

The thick portions 63 in this example are interposed between the inner resin portions 61 and the outer resin portions 62, and cover the connecting areas between the core piece 31 and 32 including contact portions between the end faces 31*e* of the connection end portions 312 of the inner core pieces 31 and the inner end faces 32*e* of the outer core pieces 32. The thick portions 63 are formed due to the constituent resin of the resin mold portion 6 being charged into step portions between the base portions 310 of the inner core pieces 31 and the thin connection end portions 312. Thus, the thickness $t_{63}$ of the thick portions 63 is larger than the thickness of the areas that cover the base portions 310 (here, the thickness $t_{61}$ of the inner resin portions 61) by the aforementioned step height (FIG. 1). The larger the thickness $t_{63}$ of the thick portions 63 is, the more readily the connection strength between the core pieces 31 and 32 can be increased, and the more readily the strength of the magnetic core 3 as an integrated body, which is integrally held by the resin mold portion 6, can be increased. The thickness $t_{63}$ of the thick portions 63 correspond to the total of the thickness $t_{61}$ of the inner resin portions 61 and the aforementioned step height. The thick portions 63 can be thickened by increasing at least one of the thickness $t_{61}$ and the step height, and the connection strength can be further increased. The larger the thickness $t_{61}$ of the inner resin portions 61 is, the more readily the effects such as protection of the core pieces from the external environment, mechanical protection, and ensuring of insulation properties can be achieved. On the other hand, it may lead to an increase in the weight and the size of the resin mold portion 6, and consequently, an increase in the weight and the size of the reactor 1. Moreover, the larger the aforementioned step height is, the aforementioned magnetic characteristics may deteriorate, for example. Accordingly, it is conceivable, as an example, that the aforementioned thicknesses $t_{61}$ and $t_{63}$ are selected while giving consideration to the weight, dimensions, magnetic characteristics, strength, and so on.

Constituent Material

Examples of the constituent material of the resin mold portion 6 may include various resins, e.g. thermoplastic resins such as PPS resin, PTFE resin, LCP, PA resin, and PBT resin. If this constituent material is a composite resin that contains any of these resins and the aforementioned filler or the like with excellent heat conductivity, a resin mold portion 6 with excellent heat dissipation can be obtained. If the constituent resin of the resin mold portion 6 and the constituent resin of the interposed members 5 are the same resin, excellent joining properties is achieved therebetween. In addition, since the resin mold portion 6 and the interposed members 5 have the same thermal expansion coefficient, detachment, cracking, or the like due to thermal stress can be suppressed. Injection molding or the like can be used to mold the resin mold portion 6.

Method for Manufacturing Reactor

When the reactor 1 according to Embodiment 1 is manufactured, for example, the coil 2, the core pieces (here, two inner core pieces 31 and two outer core pieces 32) that constitute the magnetic core 3, and the interposed members 5 are fitted to each other to make an assembled set. Then, this assembled set is accommodated in a mold (not shown) for the resin mold portion 6, and the core pieces are covered with the molding material. Thus, the reactor 1 can be manufactured.

In this example, the aforementioned assembled set can be readily obtained by disposing the wound portions 2*a* and 2*b* on the coil sides of the interposed members 5, inserting the inner core pieces 31 into the respective open holes, and disposing the outer core pieces 32 on the core sides. The aforementioned assembled set obtained before the resin mold portion 6 is provided with spaces that are in communication with the interior of the wound portions 2*a* and 2*b* from the outer core piece 32 sides as mentioned above, and these spaces can be favorably used as flow paths for the molding material.

The assembled set is accommodated into the mold, and the molding material is charged. As a method of charging the molding material, unidirectional charging, namely charging from one of the outer core pieces 32 toward the other outer core piece 32, bidirectional charging, namely charging from the two outer core pieces 32 towards the interior of the wound portions 2*a* and 2*b*, or the like may be used. In any charging method, the outer end face(s) 32*o* of the outer core piece(s) 32 serves as a position(s) to start charging the molding material, and the molding material is charged from an end portion(s) of the wound portions 2*a* and 2*b* via the outer core piece(s) 32. The molding material flows via the outer-peripheral faces of the outer core pieces 32 into the introduction spaces $g_{312}$, and further flows, via the introduction spaces $g_{312}$, into the cylindrical gaps $g_{31}$.

In any charging method, excellent manufacturability of the reactor 1 is achieved if the inner core pieces 31 have connection end portions 312 at two ends of the base portions 310 as in this example. This is because the magnetic core 3 can be readily assembled, the introduction spaces $g_{312}$ facilitate deaeration and the like, and the molding material can be more readily introduced. In a case of performing unidirectional charging, the connection end portion 312 can be provided only at an end of each inner core piece 31, and the outer end face 32*o* of the outer core piece 32 to which this connection end portion 312 is connected can be disposed at a position to start charging. In the case of performing unidirectional charging, the connection end portions 312 can also be provided at two ends of each inner core piece 31.

Usage

The reactor 1 according to Embodiment 1 can be used as a component of a circuit that performs an operation to boost or reduce a voltage, such as a constituent component of any of various converters and power conversion devices. Examples of the converters may include a vehicle converter (typically, a DC-DC converter) that is to be mounted in a vehicle such as a hybrid vehicle, a plug-in hybrid vehicle, an electric vehicle, and a fuel-cell vehicle, as well as a converter for an air-conditioner.

Effects

The reactor 1 according to Embodiment 1 has the thick portions 63 at the positions at which the resin mold portion 6 covers the connecting areas between the inner core pieces 31 and the outer core pieces 32. The thick portions 63 has a thickness larger than the thickness $t_{61}$ of the inner resin portions 61 of the resin mold portion 6 that cover the base portions 310 of the inner core pieces 31, and are unlikely to crack. The reactor 1 according to Embodiment 1 that have these thick portions 63 has increased strength of the magnetic core 3 as an integrated body that is integrally held by the resin mold portion 6, and has excellent strength. Accordingly, even if the core pieces 31 and 32 are not connected to each other by means of an adhesive or the like, the magnetic core 3 can be integrally held firmly due to the thick portions 63 being provided. Also, due to the resin mold portion 6 in this example including the inner resin portions 61 and the outer resin portions 62, and these portions being continuously and integrally formed, the rigidity of the magnetic core 3 as an integrated body can be increased by the resin mold portion 6. Also, since the thick portions 63 are locally provided in the resin mold portion 6, the reactor 1 is smaller than in a case where the overall thickness of the resin mold portion 6 is large, but has excellent strength.

Also, in the reactor 1 according to Embodiment 1, the inner core pieces 31 have the connection end portions 312 as the connecting areas between the inner core pieces 31 and the outer core pieces 32, and thus, the introduction spaces $g_{312}$ can be formed near the opening portions of the cylindrical gap $g_{31}$. Accordingly, in the reactor 1 according to Embodiment 1, although each of the outer core pieces 32 has a large-area portion that has the magnetic-path cross-sectional area $S_{32}$ larger than the magnetic-path cross-sectional area $S_{31}$ of the inner core pieces 31, the molding material can be readily introduced via the introduction spaces $g_{312}$ into the cylindrical gaps $g_{31}$, and the resin mold portion 6 can be readily formed.

In addition, in the reactor 1 according to Embodiment 1, the relative permeability of the outer core pieces 32 is higher than the relative permeability of the inner core pieces 31. Thus, even if the connection end portions 312 of the inner core pieces 31 that serve as the connection areas between the inner core pieces 31 and the outer core pieces 32 are locally thin, leakage flux between the core pieces 31 and 32 can be reduced. Accordingly, with the reactor 1 according to Embodiment 1, an increase in loss caused by the aforementioned leakage flux can be reduced, and the reactor 1 is a low-loss reactor.

In the reactor 1 according to Embodiment 1, insulation properties between the wound portions 2*a* and 2*b* and the inner core pieces 31 are improved by the inner resin portions 61. Also, the wound portions 2*a* and 2*b* are not covered by the resin mold portion 6 but are exposed, and thus can be brought into direct contact with a cooling medium such as a liquid coolant, for example. Accordingly, excellent heat dissipation is achieved. In particular, in the reactor 1, each of the outer core pieces 32 has the aforementioned large-area portion. Thus, heat can be readily released from the large-area portion, and the large-area portion can be readily brought into contact with the aforementioned cooling medium compared with a case where the outer core pieces have a uniform magnetic-path cross-sectional area $S_{31}$. For this reason as well, excellent heat dissipation is achieved. Due to the large-area portion being provided, more excellent heat dissipation is achieved if the surface area of each outer core piece 32 is larger than that of an outer core piece that has a uniform magnetic-path cross-sectional area $S_{31}$.

The reactor 1 in this example also exhibits the following effects.

(1) The connection strength between the core pieces 31 and 32 can be further increased, and the molding material can be more readily introduced into the cylindrical gaps $g_{31}$.

This is because the thick portions 63 and the introduction spaces $g_{312}$ are provided to form a ring shape along the outer peripheries of the connection end portions 312 of the inner core pieces 31.

This is also because the inner core pieces 31 also include a plurality of introduction grooves 315 in addition to the connection end portions 312. The resin mold portion 6 in this example has a plurality of thick resin portions that cover the introduction grooves 315, continuously with the thick portions 63.

This is also because each of the inner-peripheral faces that form the introduction grooves 315 includes an inclined face for guiding the molding material toward the cylindrical gap $g_{31}$ side.

(2) A lower-loss reactor 1 can be obtained.

Since the inner core pieces 31 are molded bodies of a composite material with a relative permeability that is 5 or more and 50 or less, and the outer core pieces 32 are green compact molded bodies with a relative permeability that is 50 or more and 500 or less and also is twice or more the relative permeability of the inner core pieces 31, a magnetic core 3 with a gapless structure can be employed. This is because, with the magnetic core 3 with a gapless structure, loss caused by a magnetic gap does not substantially occur.

This is because the connection end portions 312 of each inner core piece 31 are exposed from the wound portion 2*a* (or 2*b*), and loss caused by leakage flux from the connection end portions 312 can be reduced.

(3) A smaller reactor 1 can be obtained.

This is because, due to employing a gapless structure, the size of the cylindrical gap $g_{31}$ can be reduced, and the thickness $t_{61}$ of the inner resin portions 61 can be reduced.

This is also because, by employing molded bodies of a composite material as the inner core pieces 31 and employing green compact molded bodies as the outer core pieces, the size of the magnetic core 3 can be more readily reduced than in a case where the magnetic core is constituted by molded bodies of a composite material.

Note that, even if the cylindrical gaps $g_{31}$ are small, the introduction spaces $g_{312}$ can be formed around the connection end portions 312 as mentioned above, and thus, the molding material can be readily introduced into the cylindrical gaps $g_{31}$, and the resin mold portion 6 can be readily formed.

(4) By employing molded bodies of a composite material as the inner core pieces 31, excellent anti-corrosion properties can also be achieved since resin is contained. Also, even if the inner core pieces 31 include the base portions 310 and the connection end portions 312, and further have an uneven shape with the introduction grooves 315 and the protrusions 317, the inner core pieces 31 can be readily and accurately molded, and have excellent manufacturability.

(5) Excellent anti-corrosion properties can be achieved by employing green compact molded bodies as the outer core pieces 32 and covering the substantially entire outer core pieces 32 with the outer resin portions 32.

(6) The number of core pieces that constitute the magnetic core 3 is small, and the number of components to be fitted is also small (in this example, a total of seven components; namely the coil 2, the core pieces, and the interposed members 5). Thus, excellent operability is achieved.

(7) Excellent strength is also achieved since the number of core pieces that constitute the magnetic core 3 is small, and the number of connection areas between the core pieces is thus small.

The present disclosure is not limited to the above examples.

For example, at least one of the following changes (a) to (d) may be made to the above-described Embodiment 1.

(a) A coil of a self-fusing type is provided.

In this case, wires with a fusion layer is used. After the wound portions 2*a* and 2*b* are formed, adjacent turns are joined by the fusion layer by heating the wound portions 2*a* and 2*b* to fuse and solidify the fusion layer. By employing a coil of a self-fusing type, the shape of the wound portions 2*a* and 2*b* can be maintained when, for example, the coil 2 and the magnetic core 3 are fitted. As a result, excellent assemblability is achieved.

(b) A plurality of inner core pieces are provided, and gap portions that are interposed between the inner core pieces are provided.

For example, if three inner core pieces are provided, it is conceivable, as an example, that each of the inner core pieces disposed at the end portions of the wound portions 2*a* and 2*b* has the base portion 310 with the magnetic-path cross-sectional area $S_{31}$ and the connection end portions 312 with the magnetic-path cross-sectional area $S_{312}$, and the core pieces disposed at intermediate portions of the wound portions 2*a* and 2*b* have a uniform magnetic-path cross-sectional area $S_{31}$.

(c) The connection end portions 312 are provided only at a portion on the base portion 310 in the circumferential direction thereof, the thick portions 63 are formed to have a C-shape, rather than a ring shape, and a plurality of thick portions 63 are arranged spaced apart in the circumferential direction of the base portion 310.

In these cases as well, the thick portions 63 are provided in the connecting areas between the core pieces 31 and 32, and thus, excellent connection strength between the core pieces 31 and 32 is achieved compared with a case where the thick portions 63 are not provided. In these cases, the magnetic-path cross-sectional area $S_{312}$ of the connection end portions 312 can be readily ensured. When a plurality of thick portions 63 are provided, for example, it is conceivable that the connection end portions 312 are columnar bodies with the end faces 31*e* that have a gear-like shape, and the outer-peripheral faces of the connection end portions 312 are flush with the outer-peripheral face of the base portion 310. In other words, a mode is employed in which a plurality of groove portions that are open in the end faces 31*e* and the outer-peripheral faces are provided spaced apart from each other in the circumferential direction of the inner core pieces 31, at the end portions of each inner core piece 31. The inner core pieces 31 with such an uneven shape can be readily molded if molded bodies of a composite material are employed as the inner core pieces 31.

(d) At least one of the following items is provided:

(d1) a sensor (not shown) for measuring a physical quantity of the reactor, such as a temperature sensor, a current sensor, a voltage sensor, or a magnetic flux sensor;

(d2) a heat radiating plate (e.g. a metal plate etc.) that is attached to at least a portion of the outer-peripheral face of the coil 2;

(d3) a joint layer (e.g. an adhesive layer; an adhesive layer with excellent insulation properties is favorable) that is disposed between an installation face of the reactor and an installation target, or between the installation face and the heat radiating plate in (d2); and (d4) an attachment portion for fixing the reactor to an installation target, the attachment portion being formed integrally with the outer resin portions 62.

The invention claimed is:

1. A reactor comprising:

a coil having a wound portion;

a magnetic core that is disposed inside and outside the wound portion and forms a closed magnetic circuit; and a resin mold that includes an inner resin disposed between the wound portion and the magnetic core, and does not cover an outer-peripheral face of the wound portion, the magnetic core including:

an inner core piece including: a base having a predetermined magnetic-path cross-sectional area and arranged in the wound portion; and a connection end having a magnetic-path cross-sectional area smaller than the magnetic-path cross-sectional area of the base and provided at an end of the base; and an outer core piece including a large-area portion having a magnetic-path cross-sectional area larger than the magnetic-path cross-sectional area of the base, the outer core piece being exposed from the wound portion, wherein the outer core piece has a relative permeability higher than a relative permeability of the inner core piece, and the resin mold includes a thick portion covering a connecting area between the connection end and the outer core piece, the thick portion being thicker than an area of the resin mold that covers the base.

2. The reactor according to claim 1, wherein the base includes an introduction groove that is open in an outer-peripheral face of the base and in an end face of the base.

3. The reactor according to claim 1, further comprising:

a protrusion protruding from an outer-peripheral face of the connection end.

4. The reactor according to claim 1, wherein the inner core piece is a molded body of a composite material containing magnetic powder and resin.

5. The reactor according to claim 1, wherein the relative permeability of the inner core piece is 5 or more and 50 or less, and the relative permeability of the outer core piece is twice or more the relative permeability of the inner core piece.

6. The reactor according to claim 5, wherein the relative permeability of the outer core piece is 50 or more and 500 or less.

7. The reactor according to claim 1, wherein the connection end is exposed from the wound portion.

* * * * *